United States Patent [19]

Köster et al.

[11] 4,363,757

[45] Dec. 14, 1982

[54] METHOD FOR NONCONTAMINATING SOLIDIFICATION FOR FINAL STORAGE OF AQUEOUS, RADIOACTIVE WASTE LIQUIDS

[75] Inventors: Rainer Köster, Karlsruhe; Günter Rudolph, Weingarten; Rainer Gebauer, Bellheim; Iris Boch, Bretten; Wilfried Schröter, Karlsruhe; Jürgen Jakobs, Bruchsal, all of Fed. Rep. of Germany

[73] Assignee: Kernforschungszentrum Karlsruhe GmbH, Karlsruhe, Fed. Rep. of Germany

[21] Appl. No.: 34,690

[22] Filed: Apr. 30, 1979

[30] Foreign Application Priority Data

Apr. 29, 1978 [DE] Fed. Rep. of Germany ..... 2819086

[51] Int. Cl.[3] ..... G21F 9/16

[52] U.S. Cl. ..... 252/628; 252/629; 252/631; 264/0.5

[58] Field of Search ..... 252/301.1 W; 264/0.5, 264/117

[56] References Cited

U.S. PATENT DOCUMENTS 3,249,551 5/1966 Bixby ..... 252/301.1 W
4,031,175 6/1977 Cooper ..... 264/40.7

FOREIGN PATENT DOCUMENTS 2363475 6/1975 Fed. Rep. of Germany ... 252/301.1 W
53-8880 4/1978 Japan ..... 252/301.1 W

OTHER PUBLICATIONS

McCarthy, G. J., "High-Level Waste Ceramics", *Nuclear Technology*, 32 (1), Jan. 1977, pp. 92–100.

Mershad et al., "Packaging of Tritium-Contaminated Liquid Waste", *Nucl. Technol.* 32 (1), Jan. 1977, pp. 53–59.

Moore et al., "Leach Behavior of Hydrofracture Grout . . . ", *Nucl. Technol.* 32 (1), Jan. 1977, pp. 39–52.

*Primary Examiner*—Deborah L. Kyle
*Attorney, Agent, or Firm*—Spencer & Kaye

[57] ABSTRACT

A method for solidifying medium radioactive aqueous waste liquids, low radioactive aqueous waste liquids, and aqueous waste liquids containing tritium for final non-contaminating storage. The waste liquids are first mixed with absorbing agents, e.g., clay-like substances, hydraulic binders or mixtures thereof, to form granules or pellets of the same. The granules or pellets are then embedded with a binder which is initially present in a liquid state and later hardens. However, granules or pellets formed from medium radioactivity aqueous waste liquids or waste liquids containing tritium compounds are first clad in a first binder and thereafter embedded for final solidification with a second binder.

9 Claims, No Drawings

METHOD FOR NONCONTAMINATING SOLIDIFICATION FOR FINAL STORAGE OF AQUEOUS, RADIOACTIVE WASTE LIQUIDS

BACKGROUND OF THE INVENTION

The present invention relates to a method for the non-contaminating solidification of medium and low radioactivity aqueous waste liquids and/or waste liquid containing tritium compounds for storage, wherein the waste liquids are initially used to form pellets or granules which are thereafter embedded for storage purposes. When the waste contain easily leachable radionuclides, the granules or pellets are optionally clad or coated with a binder prior to being embedded within the same or different binder of the types set forth herein.

More than 20 years ago, it was proposed to solidify aqueous low radioactive (LAW) waste liquids by processing the radioactive wastes with hydraulic binders, e.g., cement, into transportable bodies. In order to achieve as uniform distribution of the radioactive substances in such a solid body as possible, and in an effort to accommodate as large of a quantity of the waste liquid in such a solid body as possible, absorbing substances, such as, for example, montmorillonite or heat treated vermiculite etc., were mixed with the cement. The hardened shaped bodies of said mixtures and aqueous LAW waste liquids, however, exhibited a relatively low resistance to leaching. The leaching rates for the harmful radionuclides cesium$^{137}$ or strontium$^{90}$ etc. were high and the aforementioned cement solidification processes thus proved to be unsatisfactory for aqueous LAW liquids and useless for medium radioactive category (MAW) liquids.

In an effort to overcome these disadvantages, attempts were then made to bind the radioactive waste waters or slurries in bitumen. According to this process, water was evaporated during the addition of the waste waters or slurries to the liquid bitumen, resulting in the solids and salts being enclosed in the bitumen. Due to its properties, the bitumen matrix could have been used not only for LAW liquids, but also for MAW liquids; these properties include larger volume reduction of the wastes, higher concentrations of the radioactive substances, better leaching resistance by 2 to 3 powers of ten as compared to the cement stone solid bodies.

However, it has been found that waste liquids containing salts, such as, e.g., sodium sulfate or sodium carbonate, resulted in the formation of bitumen products which have lost the otherwise good leaching properties of the bitumen waste salt products. Moreover, the bitumen waste products exhibit a relatively poor heat conductance. Processes similar to butumination, wherein organic polymers, for example, polyethylene, polyvinyl chloride, polystyrene, and polyurethane, are used as the matrix instead of bitumen, have also been proposed. These waste products, however, exhibit an undesirably low radiation resistance, particularly when MAW wastes are incorporated in the matrices.

In order to provide assurance against leaching, a non-corroding coating or lining, e.g., of cast resin, was recommended for the containers which were to receive the solid bodies of cement stone having radioactive substances incorporated therein (see German Pat. No. 1,082,993). This process, however, is complicated and expensive, and thus, not practical. Moreover, there is no assurance that leaching will not occur when the containers are deformed, for example, during the placement thereof into final storage.

Cement solidification processes have been essentially practiced in accordance with the following two techniques:

1. mixing within the barrel or drum; and
2. mixing in a mixer, and filling metered quantities into the containers.

The disadvantage of the first process is the difficulty of obtaining high capacities and, in the second process, the mixer becomes easily clogged.

The following methods have been used or discussed for the treatment of liquids containing tritium compounds:

1. discharge of the majority of the waste waters directly into the main sewage channel;
2. partial evaporation into the atmosphere;
3. pressing into storage rock underground; however this method requires the presence of suitable geological structures, possibly at the location of the reprocessing plant; and
4. binding tritium containing waste waters with, for example, hydraulic binders, such as cements; however, this process leads to products which, (a) have relatively high tritium water vapor pressures, and (b) exhibit relatively rapid leaching of the tritiated water.

It is also significant to note that in large reprocessing systems (capacities of about 1500 tons or more per year), and in the case of highly spent fuel elements, the environment must not be charged with large quantities of tritium.

A need therefore exists for a useful solidification process for all, or at least almost all occurring aqueous waste liquids, i.e., for LAW and MAW waste liquids as well as for liquids containing tritium compounds. Such a process has not been available prior to this invention.

OBJECTS OF THE INVENTION

It is therefore a significant object of the present invention to satisfy a long-standing need for solidifying low and medium radioactivity and/or tritium containing waste liquids for final noncontaminating storage wherein all aqueous waste solutions obtained in reprocessing plants or other nuclear energy plants or operations, except for highly active waste liquids, can be solidified and permanently stored without danger to the environment and at little expense.

It is also an object of the present invention to avoid the disadvantages of the prior art solidification processes.

A still further object of the present invention is to produce products exhibiting a high resistance to leaching, good radiation resistance and relatively good heat conductance.

Still another object of the present invention is a process for preparing products that can be manufactured in hot cells or otherwise solidified in a continuous manner as well.

SUMMARY OF THE INVENTION

To achieve the foregoing objects and in accordance with its purposes, the present invention provides a method for solidifying low and medium radioactivity liquid waste and/or liquid waste containing tritium compounds for final noncontaminating storage by initially granulating or pelletizing the aqueous radioactive waste liquid with an absorbing, clay-like substance, and/or a hydraulic binder. The granules or pellets are thereafter embedded, for final solidification, in a binder selected from the group including liquefied polymerizing plastics which are polycondensing or polyadding plastics and aqueous suspensions of hydraulic binders, which are initially present in the liquid state and later harden. Optionally, the resulting granules or pellets are enclosed or otherwise clad, prior to the embedding step, in a binder selected from the group including liquefied polymerizing plastics which are polycondensing or polyadding and aqueous suspensions of hydraulic binders, which are initially present in a liquid state and later harden.

DETAILED DESCRIPTION OF THE INVENTION

The process according to the invention operates according to the building block principle, i.e., LAW liquids or waste liquids containing only difficulty leachable radionuclides are first combined with an absorbing, clay-like substance and/or a hydraulic binder to form pellets or granules which are thereafter incorporated or embedded directly into the inactive solidification matrix defined hereinbefore. To provide an additional barrier against the release of radionuclides into the environment, these pellets can be clad with an inactive coating prior to embedding. However, MAW waste liquids or aqueous wastes containing easily leachable radionuclides, such as, for example, cesium$^{137}$ or strontium$^{90}$ are first combined with an absorbing, clay-like substance and/or a hydraulic binder to form pellets or granules and then clad in an inactive, hardened coating. This coating step could, however, also be omitted. The pellets or granules are then incorporated into the liquid binder, which is capable of hardening to form a final solidified matrix having a plurality of coated or uncoated granules or pellets embedded therein. The process of this invention can also be used for waste liquids containing either smaller or larger tritium concentrations because of the building block principle disclosed herein.

A particularly preferred embodiment of the present invention relates to the formation of granules or pellets by spraying the aqueous, radioactive waste liquid onto the absorbing, clay-like substance and/or the hydraulic binder substances which are conveyed on a moving pelletizing plate is known in the ore processing art, however, the material to be pelletized in ore processing is contained in the solid matter whereas the radionuclides to be solidified in the process of this invention are sprayed together with the liquid onto the solid matter. In the present invention, hardening of the solid matter with the radioactive liquid is not necessary at this stage of the process, and the mere adhesion of the liquid or the sorption of the radionuclides, respectively, onto the solid matter is sufficient. The size of the pellets produced in the present invention can range, for example, from about 1 to about 20 mm in diameter. See, H. B. Ries, "Aufbaugranuliering," *Aufbereitungs-Technik,* 1971 No. 11, for a description of pelletizing techniques.

In the embodiment of the invention where there is a cladding or coating of the granules or pellets in which the radionuclides are incorporated, the cladding or coating is advantageously effected by spraying a mixture of styrene, divinyl benzene and azo-bis-isobutyric acid dinitrile. Other binders of the group of plastics formed by liquid polymerizing addition polymers and condensation polymers which are initially present in liquid state, but later harden, as well as aqueous suspensions of hydraulic binders, can be sprayed onto the granules or pellets in order to clad them. Suitable examples include polyurethane resins and epoxy resins as well as grouts of cement or plaster of Paris. The cladding of the pellets or granules provides the granules or pellets with an additional barrier against leaching before they are finally embedded within the solidification matrix. The influence of radiation on the cladding, particularly when plastics are used for this purpose, is greatly reduced by the clay-like and/or hydraulic binder substances present in the granules or pellets, respectively.

When the granules or pellets are clad or otherwise coated in the manner discussed herein, these coatings should generally have a thickness of from about 0.1 to 5 mm and preferably 0.2 to 3 mm.

The preparation of the granules or pellets, respectively, with the aid of pelletizing plates in accordance with this invention, has the great advantage that the process of this invention can also be carried out continuously, particularly where a plurality of process steps are involved and that the throughput of waste liquids can be easily varied depending on the size of the pelletizing plate or plates.

When the waste waters to be solidified contain tritium, a salt anhydride, for example $CaSO_4$, or a cement, e.g., Portland cement, can be used as the hydraulic binder for making the granules or pellets, respectively.

The clay-like materials useful in the practice of this invention include clays which are essentially hydrated aluminum silicates as well as equivalent materials. Particularly useful clay-like materials include, e.g., bentonite, illite, kaolinite, vermiculite, etc.

It is understood that either a clay-like substance or hydraulic binder or mixtures thereof, can be used in the granulating ,r pelletizing step of the process of this invention. When mixtures of clay-like substances are employed with a hydraulic binder, e.g., Portland cement, the weight ratio range of the clay-like substance to hydraulic binder is generally between 1:15 and 1:2, preferably between 1:12 and 1:8.

The weight ratio of waste liquid to the clay-like substance or hydraulic binder for the granulation step generally lies in the range of 1:10 to 1:3 and preferably between 1:7 to 1:4. The process described here is applicable to both LAW and MAW solutions where LAW (low activity waste) comprises all types of radioactive wastes which can be handled and transported essentially without shielding against radiation, and MAW (medium activity waste) comprises such wastes which require shielding to protect against radiation but which generate only negligible amount of heat of radiation.

In accordance with a particularly preferred embodiment of the present invention, the absorbing, clay-like substance is a special mixture of natural bentonite and a hydraulic binder which is Portland cement, both being used in a weight ratio range of bentonite to Portland cement between 1:15 and 1:2 to form the granules or pellets, respectively. The weight ratio of waste liquid to the bentonite—Portland cement mixture lies in the range of 1:10 to 1:3.

Other hydraulic binders useful for the granulation or pelletization step can include, for example, shaft furnace cements (HOZ), or trass cements (TZ), iron Portland cements (EPZ), or Portland cements of high resistance to sulfate attack.

It is understood that other suitable hydraulic binders or cements known in the art can be used in the practice of this invention.

The granules or pellets respectively produced in accordance with this invention or the clad granules or clad pellets, respectively, also produced in accordance with this invention are embedded for final solidification in an initially liquid, later-hardening binder, as noted hereinbefore, and then filled either into containers or barrels and left to harden therein. These materials can also be conveyed into underground cavities, with the aid of an in situ introduction technique, where the solidification matrix hardens. Where conveyance into underground cavities is employed, a cement-water mixture is advantageously used as the solidification matrix or the embedding matrix, respectively. The liquids for the final embedding generally are from the same group as those described above for the cladding step, but may also include other substances which are not suitable to form a cladding, e.g. urea-formaldehyde resin. The embedding of the pellets into an inactive liquid which later hardens is done in order to produce a solid body with no interstices left between the pellets. In this way the susceptibility towards attack or leaching by any liquid in contact with the product is greatly reduced as the surface of the pellets containing the radioactive waste products is totally protected by the embedding matrix.

The invention will now be explained by way of examples which follow without, however, being limited to these examples.

EXAMPLE 1

(a) 40 ml of a simulated MAW concentrate solution of the following composition was used:

$NaNO_3$—450.0 g/l
$NaNO_2$—5.0 g/l
$Fe(NO_3)_2$—0.1 g/l
$Ni(NO_3)_2$—0.01 g/l
$Cr(NO_3)_3$—0.01 g/l
$Ca(NO_3)_2$—0.15 g/l
$Mn(NO_3)_2$—0.02 g/l
$Sr(NO_3)_2$—0.002 g/l
$Mg(NO_3)_2$—0.2 g/l
$Ce(NO_3)_4$—0.02 g/l
$Al(NO_3)_3$—0.03 g/l
Tributyl phosphate—0.2 g/l
Dibutyl phosphate—0.1 g/l
Kerosene—0.02 g/l
Sodium oxalate—10.0 g/l
Sodium tartrate—10.0 g/l
NaF—2.0 g/l
Detergents—2.0 g/l
Cs—0.004 g/l
P in the form of $NaH_2PO_4$—0.2 g/l The MAW solution was started with $HNO_3$ (~1 m). Before solidification, a pH of 8.5–9 was set with NaOH. The solution, containing a cesium$^{137}$ tracer, was sprayed onto a Portland cement-bentonite mixture (120 g Portland cement and 10 g bentonite) present on a pelletizing plate having a diameter of 40 cm and having an angle of inclination of 46°, said plate rotating at a rate of 26 rpm for a few minutes. Granules developed, having a diameter of between 5 and 10 mm. These granules were then permitted to harden at room temperature for four weeks in a water vapor saturated atmosphere. The leaching rate for cesium was then determined in accordance with the IAEA standard method. It was found that the leaching rate was lower by a factor 20 than in a comparative sample without bentonite being present and produced in the same manner.

(b) The granules or pellets thus obtained were then covered with the same volumetric amount of an inactive cement/water mixture (water/cement values about 0.45) and were thus encased in an inactive matrix and left to harden. After 60 days of leaching, these products evidenced Na leaching rates less than the non-embedded products by a factor of 8. The embedding of these granules or pellets results in an improvement in the leaching resistance, as well as other advantages including a monolith formation and a reduced surface area.

EXAMPLE 2

Pellets of a simulated MAW concentrate and a Portland cement/bentonite mixture which had been produced in accordance with Example 1, above, were sprayed with a mixture of styrene, divinyl benzene and an azo-bis-isobutyric acid dinitrile catalyst (5 percent by weight) with the aid of a second pelletizing plate and were coated with this mixture. The ratio of styrene to divinyl benzene was 80:20 on a volume percent basis. The pellets accepted a monomer quantity of 2 percent by weight with respect to the total mass of pellets. Due to the relatively low water content of the pellets, their capability of absorbing the monomers was high which greatly facilitated the cladding process. With said cladding, the leaching rate for sodium could be improved by the factor of 3 as compared to unclad comparison pellets. Optimization of pellet production and of the plastic cladding process, e.g., higher monomer charge rates, promise further reductions in leaching. Embedding of the coated pellets can be done as described in Example 1.

EXAMPLE 3

Solidification of Tritium Containing Waste Waters

Pellets having a diameter of about 5 mm were produced from a mixture of Portland cement, bentonite and tritium containing water having a total content of 504 microcurie tritium and a water-cement value of 0.33. These pellets were permitted to harden for four weeks and then, as described in Example 2, sprayed with a mixture of styrene, divinyl benzene and an azo-bis-isobutyric acid dinitrile and permitted to polymerize to form clad pellets. The clad pellets had a plastic coating thickness of 2 to 3 mm on the cement balls. These pellets exhibited a differential leaching rate in water as the leaching medium, and at room temperature wherein the rate was 500 to 1000 times better than that of the pure cement products without any plastic cladding. The leaching was effected in accordance with the IAEA standard method. The leaching rates apply for leaching periods of up to 14 days. The water vapor pressure and thus the proportional tritium water vapor pressure as well, were noticeably lowered by the presence of the plastic cladding. The partial water vapor pressure on fresh cement samples at 20° C. was 18 Torr. After spraying with the plastic mixture and the polymerization of this plastic, the available measuring instrument was unable to determine any water vapor pressure, and thus was less than one Torr. Embedding of the coated pellets can be done as described in Example 1. The following two examples refer only to the pelletization step of the invention.

EXAMPLE 4

The test was conducted in order to provide a comparison of various clay-like substances as additives to types of Portland cement or trass cement with respect to their effectiveness in increasing the leaching resistance of uncoated pellets for cesium.

Pellets having a water/cement value of 0.3 to 0.4 were produced from various mixtures of cement and clay-like substances. The aqueous waste liquid was a simulated MAW concentrate, as described in Example 1. The hardened pellets contained about 10 percent by weight salts. The hardening time was 28 days in closed containers. The leaching determinations were made in accordance with the IAEA method at 20° C. or according to an accelerated testing method at 80° C., respectively. The values for the effective diffusion constants for cesium are set forth in the following Tables.

TABLE 1

| Leaching agent: water, 20° C. | |
|---|---|
| Binder: Portland cement 350F + | Effective diffusion coefficients: $D[cm^2 \cdot d^{-1}]$ (for Cs) |
| +5 weight percent natural bentonite (with reference to the end product) | $5 \times 10^{-7}$ |
| + bentonite earth, 5 percent by weight | $3 \times 10^{-5}$ |
| + active bentonite, 5 percent by weight | $1 \times 10^{-4}$ |
| + illite, 5 percent by weight | $2 \times 10^{-4}$ |
| + kaolinite, 5 percent by weight | $7 \times 10^{-4}$ |
| + vermiculite, 5 percent by weight | $8 \times 10^{-4}$ |

TABLE 2

| Leaching agent: water or saturated NaCl solution, respectively at 80° C. (accelerated test)* | | |
|---|---|---|
| Binder: Portland cement 350F (PZ) or trass cement (TZ) with or without natural bentonite or sodium bentonite (swellable) | Effective diffusion coefficient $D[cm^2 \cdot d^{-1}]$ (for Cs) | |
| | Leaching agent $H_2O$ | Leaching agent NaCl solution |
| PZ | $7 \times 10^{-2}$ | $3 \times 10^{-2}$ |
| PZ + 5% by weight natural bentonite | $7 \times 10^{-4}$ | $9 \times 10^{-4}$ |
| PZ + 10% by weight natural bentonite | $3 \times 10^{-6}$ | $6 \times 10^{-5}$ |
| PZ + 20% by weight natural bentonite | $9 \times 10^{-6}$ | $2 \times 10^{-5}$ |
| TZ | $2 \times 10^{-2}$ | $1 \times 10^{-2}$ |
| TZ + 5% by weight natural bentonite | $1 \times 10^{-3}$ | $1 \times 10^{-3}$ |
| TZ + 10% by weight natural bentonite | $8 \times 10^{-5}$ | $8 \times 10^{-5}$ |
| TZ + 20% by weight natural bentonite | $7 \times 10^{-6}$ | $7 \times 10^{-5}$ |
| PZ + 5% by weight sodium bentonite | $1 \times 10^{-3}$ | $1 \times 10^{-3}$ |
| PZ + 10% by weight sodium bentonite | $2 \times 10^{-4}$ | $5 \times 10^{-4}$ |
| PZ + 20% by weight sodium bentonite | $2 \times 10^{-4}$ | $1 \times 10^{-3}$ |
| TZ + 5% by weight sodium bentonite | $7 \times 10^{-3}$ | $8 \times 10^{-4}$ |
| TZ + 10% by weight sodium bentonite | $5 \times 10^{-4}$ | — |
| TZ + 20% by weight sodium bentonite | $3 \times 10^{-3}$ | — |

*without changes in the leaching agent, greater ratio of volume of leaching medium to sample volume than in the IAEA test.

EXAMPLE 5

A test was conducted in order to provide a comparison of the various types of cement, when used in admixture with 10 percent by weight natural bentonite with regards to their effectiveness in increasing the leaching resistance of unclad pellets for cesium. The pellets were produced in a manner corresponding to that described in Example 4, and the leaching tests were made according to the rapid test method at 80° C. with water.

| Type of Cement | Effective diffusion coefficients for Cs $D / cm^2 \times d^{-1} /$ |
|---|---|
| Trass cement 350F | $3 \times 10^{-5}$ |
| Portland cement 450F | $1 \times 10^{-5}$ |
| Portland cement 450F Antisulfate (free of C3A-Phase) | $1 \times 10^{-4}$ |
| Iron Portland cement 350F | $6 \times 10^{-5}$ |
| Shaft furnace cement 450F | $2 \times 10^{-5}$ |
| Trass cement | $8 \times 10^{-5}$ |

It will be understood that the above description of the present invention is susceptible to various modifications, changes and adaptations, and the same are intended to be comprehended within the meaning and range of equivalents of the appended claims.

What is claimed is:

1. Method for solidifying medium radioactivity aqueous waste liquids, low radioactivity aqueous waste liquids, and tritium containing aqueous waste liquids for final non-contaminating storage wherein the waste liquids are mixed with absorbing agents and/or with hardening agents and the radionuclides contained in the waste liquids are incorporated in a first solidifying matrix produced with the aid of these agents, and said first matrix is encased within at least one hardening matrix free of waste radionuclides without creating any interstices, comprising the steps of:

(a) granulating or pelletizing the aqueous, radioactive waste liquid solely by the single step of spraying said aqueous radioactive waste liquid onto a mixture of an absorbing, natural bentonite and a hydraulic binder, which mixture is being transported on a rotating pelletizing plate, so as to form said granules or pellets, the weight ratio of bentonite to hydraulic binder in the mixture being between 1:15 and 1:2;

(b) (1) embedding for final solidification said granules or pellets, wherein radionuclides from radioactive aqueous liquids are incorporated therein, in a binder which is initially present in a liquid state and later hardens, said binder being selected from the group consisting of polymerizable liquids which polymerize by condensation polymerization or addition polymerization and aqueous suspensions of hydraulic binders, or (2) cladding granules or pellets formed from radioactive aqueous waste liquids for final solidification with a first binder initially present in a liquid state and which later hardens, said first binder being selected from the group consisting of polymerizable liquids which polymerize by condensation polymerization, or addition polymerization and aqueous suspensions of hydraulic binders; and (c) embedding for final solidification said clad granules or clad pellets in a second binder initially present in a liquid state and which later hardens, said second binder being selected from the group consisting of polymerizable liquids which polymerize by condensation polymerization or addition polymerization and aqueous suspensions of hydraulic binders.

2. The method as defined in claim 1 wherein cladding of said granules or pellets in which radionuclides are incorporated is accomplished by spraying on said granules or pellets, a mixture of a styrene, divinyl benzene and azo-bis-isobutyric acid dinitrile.

3. The method as defined in claim 1 comprising granulating or pelletizing waste waters containing tritium with a salt anhydride or a cement as the hydraulic binder.

4. The method as defined in claim 1 wherein said hydraulic binder is Portland cement ratio.

5. The method as defined in claim 4 wherein the weight ratio of waste liquid to said bentonite/Portland cement mixture for the granulating or pelletizing process, respectively, lies in the range of 1:10 to 1:3.

6. Method as defined in claim 1 wherein said hydraulic binder employed for the granulation or pelletizing step is a shaft furnace cement, a trass cement, an iron Portland cement or a Portland cement of high resistance to sulfate attack.

7. The method as defined in claim 1, wherein the hydraulic binder is cement.

8. The method as defined in claim 6 or 7, wherein the weight ratio of waste liquid to said bentonite/cement mixture for the granulating or pelletizing process, respectively, lies in the range of 1:10 to 1:3.

9. The method as defined in claim 1, wherein the weight ratio of waste liquid to said bentonite/hydraulic binder mixture for the granulating or pelletizing process, respectively, lies in the range 1:10 to 1:3.

* * * * *